US005562806A

United States Patent [19]

Abdulmassih et al.

[11] Patent Number: 5,562,806

[45] Date of Patent: Oct. 8, 1996

[54] VARIABLE ANGLE POWERED CYCLONE

[75] Inventors: Antoine G. Abdulmassih, San Francisco, Calif.; A. Sean Vote, Colorado Springs, Colo.

[73] Assignee: Beloit Technologies, Inc., Wilmington, Del.

[21] Appl. No.: 398,317

[22] Filed: Mar. 3, 1995

[51] Int. Cl.[6] ..... B02C 13/22

[52] U.S. Cl. ..... 162/261; 162/243; 241/154; 241/189.1; 241/194

[58] Field of Search ..... 162/57, 17, 65, 162/261, 23, 243; 241/189.1, 194, 55, 188.2, 154, 599

[56] References Cited

U.S. PATENT DOCUMENTS

| | | | |
|---|---|---|---|
| 2,722,163 | 11/1955 | Cumpston, Jr. | 241/195 |
| 3,471,093 | 10/1969 | Wienert | 241/194 X |
| 3,725,193 | 4/1973 | De Montigny et al. | 162/17 |
| 4,277,371 | 1/1994 | Bowns et al. | 241/154 |
| 4,303,470 | 12/1981 | Meredith et al. | 162/57 |

*Primary Examiner*—Donald E. Czaja
*Assistant Examiner*—Jose A. Fortuna
*Attorney, Agent, or Firm*—Dirk J. Veneman; Raymond W. Campbell

[57] ABSTRACT

A varying tapered conical shell is provided with a varying taper conical rotor having pinlike radially extending projections whereby the varying taper assures more uniform solids distribution in a fluffing solids/gas contactor.

11 Claims, 1 Drawing Sheet

VARIABLE ANGLE POWERED CYCLONE

BACKGROUND OF THE INVENTION

This invention relates generally to pulp manufacturing processes and equipment, and more particularly to an apparatus for fluffing high consistency pulp in the presence of a gaseous bleaching agent for promoting intimate contact between pulp and bleaching reagent.

Also, more particularly, the present invention relates to a means of manipulating wood pulp fibers within a rotary driven pin type fluffer cyclone to extend the fluffing time and promote uniform mat formation in the presence of a gaseous bleaching agent.

As is known, wood pulp is obtained from the digestion of wood chips, from repulping recycled paper, or from other sources and is commonly processed in pulp and paper mills in slurry form in water. Recently there have been many efforts to use ozone as a bleaching agent for high consistency wood pulp. Although ozone may initially appear to be an ideal material for bleaching lignocellulosic materials, the exceptional oxidative properties of ozone and its relatively high cost in the past have limited the development of satisfactory devices.

The primary characteristic of pulp slurries which changes with the consistency of the slurry is the fluidity. Wood pulp in the high consistency ranges (above 18–20% oven-dry consistency) does not have a slurry like character, but is better described as a damp, fibrous solid mass. High consistency pulp can be fluffed, in the same way that dry fibrous solids such as cotton or feathers can be fluffed, to give the pulp a light and porous mass, the inner fibers of which are accessible to a chemical reagent in gaseous form.

The characteristic of compressibility of fluffed pulp, however, makes it difficult to move or transport in conventional solids bulk handling equipment without increasing the bulk density and reducing the porosity (void volume).

To realize fully the advantages of the gas phase reaction in a multistage bleaching of cellulosic fibrous pulp, the comminution of the pulp to produce the fluffed pulp must be of a specific nature so as to produce fragments which independent of their size are of low density, and of porous structure throughout and substantially free from any highly compressed portions, i.e., compacted fibre bundles. Only when this form of comminuted pulp is achieved can the gaseous reactants reach all parts of the comminuted pulp fragments, and thus ensure that the reaction of the gaseous reagent with the fluffed pulp proceeds rapidly and uniformly. The concern for uniformity of contact between the fluffed pulp and the bleaching reagent gas, in the case of ozone bleaching, is fostered by the rapid reduction in the concentration of ozone gas in contact with the fluffed pulp. This reduction is attributable to the extremely fast reaction rate of ozone with wood pulp. Since the reaction rate is concentration dependent, this characteristic increases the non-uniform bleaching results attendant upon the variable permeability of the pulp.

As described hereinabove, the fluffed pulp mass is easily compressed by the action of bulk solids handling equipment to form wads and clumps having much higher density and much lower gas permeability. Bleaching gas flows much more slowly through such wads and clumps and much more rapidly through the wad-to-wad contact areas. The result is overbleached contact areas and underbleached wad cores. Thus, it has been found that bleaching systems which employ conventional bulk materials handling equipment to move high consistency fluffed pulp through a bleaching retention chamber while bleaching it with ozone gas cannot successfully produce uniformly bleached pulp fiber.

Pin shredders and fluffers are used in pulp and paper manufacture and in many other industries for shredding sheet material or fluffing fibrous materials. The size of the particle produced by such a pin shredder depends on several factors such as the size and spacing of the pins, the speed of rotation, retention time, and housing clearance.

An example of such a machine is a fluffer used in high consistency bleaching experiments, and which is described in U.S. Pat. No. 3,725,193 to De Montigny. However, while this machine, and other similar machines, may have operated with varying degrees of success, these machines suffer from a plurality of shortcomings which have detracted from their usefulness.

For example, a disadvantage of using a screen (as suggested in De Montigny) to retain the coarse particles within the housing arises from the fibrous and floccular nature of moist wood pulp. For the flocs to pass through screens, the apertures or slots must be undesirably large, which will result in permitting unfluffed particles of similar size to pass.

Another class of known pin rotor machines used in pulp and paper manufacture consists of a cylindrical housing containing stationary pins on the inside which interleave with pins disposed on a rotor. Such high speed pin rotor machines have operated with varying degrees of success in the low to medium consistency ranges for processing wood pulp, for example as a steam mixer. However, these machines do not operate satisfactorily when processing high consistency pulp, because at high consistency the pulp fibers cling to the base of the stationary pins as they are thrown against them by the rotating pins and by the centrifugal forces of the rotating pulp mass, and the fibers build up to form a plugging condition in the housing, impeding thru flow of the wood pulp being processed.

One possible solution has been proposed which in effect utilizes a vertical constant taper pin rotor cone in a constant tapered conical "cyclone" housing passing the pulp and bleaching gas from top to bottom. This has proved somewhat effective but difficult to control in situations of varying flow rates. There is a tendency to develop a non-uniform pulp mat thickness due to the dynamics of rotation within the constant taper cyclone again resulting in a tendency of non-uniform bleaching at high reaction rates.

The foregoing illustrates limitations known to exist in present machines for fluffing and manipulating high consistency wood pulp. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a fluffing contactor comprising a varying tapered conical shell having an inlet for solids and gaseous reagent adjacent one end, a solids outlet adjacent an opposite end and a gaseous reagent outlet for extracting the reagent from the shell; a varying tapered conical rotor mounted for rotation within the shell of sufficient diameter to form a restricted annular space of convenient axial length; the rotor being further provided with a plurality of pinlike radially extending projections for imparting a circumferential swirl to solid fibrous material introduced within the shell; the shell and rotor being further provided with variable slope side walls forming a constant width restricted annular space.

The foregoing and other aspects will become apparent from the following detailed description of the invention when considered in conjunction with the accompanying drawing figures.

BRIEF DESCRIPTION OF THE DRAWING FIGURES

FIG. 1 is a sectional view of an apparatus according to the prior art and wherein an apparatus housing is illustrated in section to expose a pin rotor rotatably mounted therein; and FIG. 2 is a cross-sectional view of an embodiment of the apparatus of the present invention.

DETAILED DESCRIPTION

A rotary pin type fluffer contactor has been described in patent application Ser. No. 08/125,053 assigned to the same Assignee as the present invention. A vertical axis version (shown in FIG. 1) uses a conical surface to control the motion of the fibers passing through the machine.

Figure 1:
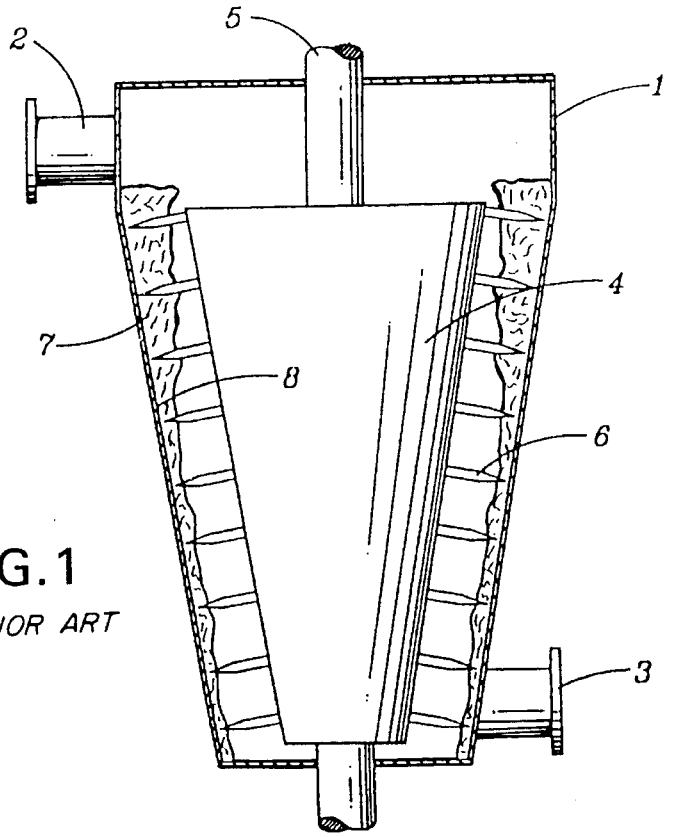
FIG. 1 PRIOR ART

As shown in FIG. 1, the fluffer is comprised of a conical housing 1 having an inlet 2 and an outlet 3 for receiving pulp fiber and a reagent gas and discharging pulp fiber respectively. A pin rotor 4 is shown which is also conical in section and is mounted for rotation within the housing 1 on a shaft 5 which extends through the housing. The rotor is further provided with a plurality of pinlike projections 6 which extend from the rotor to a point proximate (substantially through the circumferential space formed between the housing and the rotor) the internal wall of the housing.

Pulp fibers enter the machine through inlet 2 where they are then caused to be spun about the circumference of the machine by the combing action of the rotor 4 and pins 6. The centrifugal force of the pulp fiber mat 7 acting against the conical surface 8 causes the downward motion of the pulp fiber mat due to gravity to be retarded in a vertical machine. This conical surface also can be used to provide a means of traversing the pulp fibers through a horizontal machine.

For a given rate of rotation of the pulp fiber mat and a given radius of rotation, there is a conical angle of the housing that will cause an upward force on the pulp mat just equal to the downward force of gravity. To achieve a controlled downward flow of pulp the rotational speed of the rotor is adjusted to a slightly slower value than the "equilibrium" speed. This is a delicate balance, and in practice the downward velocity increases toward the bottom of the housing as the radius gets smaller, so that the mat thickness becomes thinner as shown in FIG. 1.

There is a maximum thickness of pulp mat which can be properly agitated and fluffed by a pin rotor. An uneven pulp mat causes the fluffer to be inefficiently loaded resulting in the need for a larger and less economical machine.

Figure 2:
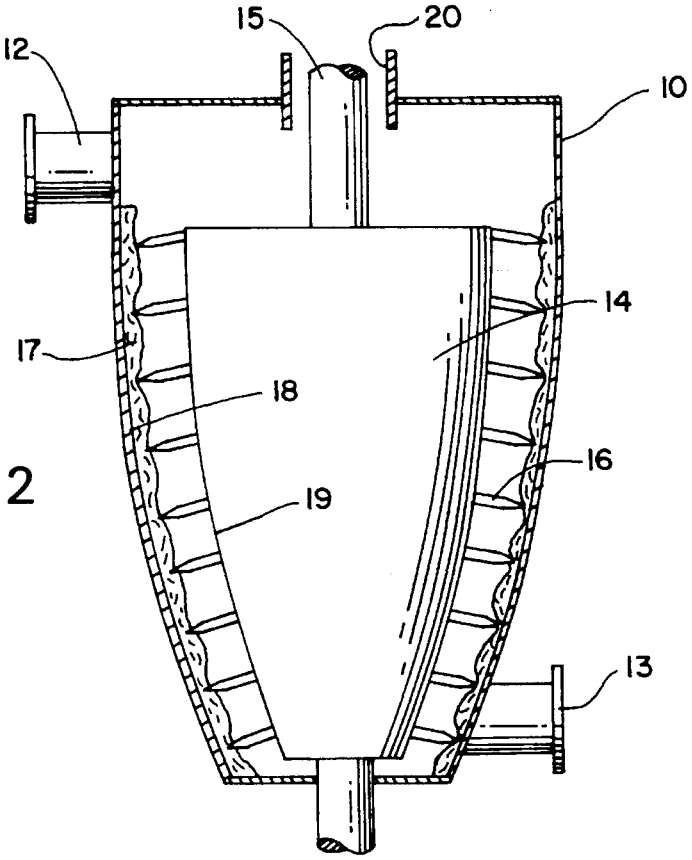

FIG. 2 illustrates a contemplated commercial embodiment of an apparatus 10 which is designed for continuously fluffing high consistency wood pulp and for continuously promoting intimate contact between the high consistency pulp and a gaseous bleaching reagent.

As shown in FIG. 2 a fluffer according to the present invention is comprised of a varying tapered conical housing 10 having a gas reagent and pulp inlet 12 and an outlet 13 for receiving and discharging pulp fiber respectively. A varying tapered conical pin rotor 14 is mounted for rotation within the housing 10 and a shaft 15 which extends through the housing. A concentric gas discharge port 20 is provided about the upper portion of shaft 15. The rotor 14 is further provided with a plurality of parabolic pinlike projections 16 which extend from the rotor to a point proximate the internal wall of the housing. The pinlike projections have a parabolic profile from base to tip and a circular cross section.

As seen in FIG. 2 the housing 10 and the rotor 14 are provided with similar varying tapered conical sides 18,19 which vary from nearly vertical at the upper inlet to a more horizontal slant at discharge. Due to the rotary dynamics of pulp circulating in the cyclone and the effects of gravity, the vertical top portion tends to promote downward movement of the pulp mat at the top of the reactor and the more horizontal slant near the bottom tends to slow its vertical downward movement at the bottom of the housing. This promotes the formation of a more uniform mat thickness 17 over a wider range of feed flow than achievable in the prior art.

A useful range of taper angle varying from 90° at the top to 60° at the bottom measured from the horizontal has been found useful in conjunction with a constant width restricted annular space in the order of 2 to 10 inches in depth. A preferred restricted annular space in the order of 6 inches has been shown to be effective in promoting the object of this invention. The above described preferred embodiment is effective for bleaching of pulp in a high consistency range (20 to 40 percent solids) with a gaseous oxygen and ozone mixture, however, other combinations of bleaching or reagent gases are contemplated.

While this invention has been illustrated and described in accordance with a preferred embodiment, it is recognized that variations and changes may be made therein without departing from the invention as set forth in the following claims:

What is claimed is:

1. A fluffing contactor comprising:

a varying tapered conical shell having a solids and gas inlet adjacent one end and a solids outlet adjacent an opposite end and a gas outlet for extracting said gas from said shell;

a varying tapered conical rotor mounted for rotation within said shell of sufficient diameter to form a restricted annular space of convenient axial length;

said rotor being further provided with a plurality of pinlike radially outward extending projections for imparting a circumferential swirl to solid fibrous material introduced within said shell; and said shell and rotor being further provided with variable slope side walls forming a constant width restricted annular space.

2. A fluffing contactor according to claim 1, wherein: said projections extend substantially through said restricted annular space.

3. A fluffing contactor according to claim 1, wherein: said restricted annular space is in the order of 2 to 10 inches in width.

4. A fluffing contactor according to claim 1, wherein: said taper comprises a taper angle varying from nearly 90 degrees from the horizontal to a more horizontal angle at discharge.

5. A fluffing contactor according to claim 4, wherein: said taper includes a taper angle in the range from 90 to 60 degrees from the horizontal from inlet to discharge.

6. A fluffing contactor according to claim 1, wherein: said projections are pins.

7. A fluffing contactor according to claim 6, wherein: said restricted annular space is approximately 6 inches in width.

8. A fluffing contactor according to claim 1, wherein: said gas is a reagent gas.

9. A fluffing contactor according to claim 8, wherein: said reagent gas is a bleaching gas.

10. A fluffing contactor according to claim 8, wherein: said bleaching gas is a mixture of ozone and oxygen.

11. A fluffing contactor for bleaching high consistency pulp wood fiber utilizing ozone gas as a bleaching agent comprising:

a varying tapered conical shell having a solids and gaseous reagent inlet adjacent one end and a solids outlet adjacent an opposite end;

a varying tapered conical rotor mounted for rotation within said shell of sufficient diameter to form a restricted annular space of convenient axial length;

said rotor being further provided with a plurality of pinlike radially outward extending projections for imparting a circumferential swirl to solid fibrous material introduced within said shell;

said shell and rotor being further provided with variable slope side walls forming a constant with restricted annular space;

said taper includes a taper angle varying in the range from 90 to 60 degrees from the horizontal from inlet to discharge.

* * * * *